US006415604B1

(12) United States Patent
Motomura et al.

(10) Patent No.: US 6,415,604 B1
(45) Date of Patent: Jul. 9, 2002

(54) HYDRAULIC CONTROL CIRCUIT FOR WORK MACHINE

(75) Inventors: Hidetake Motomura; Hiroaki Tada, both of Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/601,107

(22) PCT Filed: Nov. 18, 1999

(86) PCT No.: PCT/JP99/06440

§ 371 (c)(1),
(2), (4) Date: Oct. 2, 2000

(87) PCT Pub. No.: WO00/32880

PCT Pub. Date: Jun. 8, 2000

(30) Foreign Application Priority Data

Dec. 2, 1998 (JP) ..... 10-342935

(51) Int. Cl.[7] ..... E02F 9/20; E02F 3/43
(52) U.S. Cl. ..... 60/399; 91/419
(58) Field of Search ..... 60/399; 91/403, 91/398, 419

(56) References Cited

U.S. PATENT DOCUMENTS 6,230,090 B1 * 5/2001 Takahashi et al. ..... 91/419
6,269,637 B1 * 8/2001 Motomura et al. ..... 91/461

FOREIGN PATENT DOCUMENTS

| | | |
|---|---|---|
| JP | 5-280075 | 10/1993 |
| JP | 8-333767 | 12/1996 |

* cited by examiner

*Primary Examiner*—Edward K. Look
*Assistant Examiner*—Thomas E. Lazo
(74) *Attorney, Agent, or Firm*—Oliff & Berridge, PLC

(57) ABSTRACT

The invention relates to a hydraulic control circuit that allows operation to continue, when the working portion approaches the cab during work, and allows the working portion to stop when the working portion reaches the limit position, whereby the working efficiency is further improved. Electromagnetic proportional pressure reducing valves carry out the feeding and interruption of pilot pressurized oil into control valves on the basis of commands from the control unit, and electromagnetic selector valves are provided, wherein the electromagnetic proportional pressure reducing valves and electromagnetic selector valves are actuated when the working portion reaches the interference prevention area and limit position, whereby the hydraulic cylinders are stopped, and avoidance operation can be carried out.

10 Claims, 8 Drawing Sheets

Fig. 4

| Interference prevention area | Operated state of the operating tools | | | Operation commands | | |
|---|---|---|---|---|---|---|
| | Boom | Stick | Offset | Boom | Stick | Offset |
| Front side portion interference prevention area | Shift-down | ——— | ——— | Shift-down | OUT | ——— |
| | ——— | IN | ——— | ——— | IN stop | ——— |
| | ——— | ——— | LEFT | ——— | ——— | LEFT stop |
| | Shift-down | IN | ——— | Shift-down | OUT | ——— |
| | Shift-down | ——— | LEFT | Shift-down | OUT | LEFT |
| | ——— | IN | LEFT | ——— | OUT | LEFT |
| | Shift-down | IN | LEFT | Shift-down | OUT | LEFT |
| | Shift-up | ——— | ——— | Shift-up | OUT | ——— |
| | Shift-up | IN | ——— | Shift-up | OUT | ——— |
| | Shift-up | ——— | LEFT | Shift-up | OUT | LEFT |
| | Shift-up | IN | LEFT | Shift-up | OUT | LEFT |
| Roof portion interference prevention area | Shift-down | ——— | ——— | Shift-down stop | ——— | ——— |
| | ——— | IN | ——— | ——— | IN stop | ——— |
| | ——— | OUT | ——— | ——— | OUT stop | ——— |
| | Shift-down (*1) | IN | ——— | Shift-down | OUT | ——— |
| | Shift-down (*2) | IN | ——— | Shift-down stop | IN stop | ——— |
| | Shift-down | OUT | ——— | Shift-down stop | OUT stop | ——— |

Note: 1) Where the stick angle is an angle of elevation.
2) Where the stick angle is an angle of declination.

HYDRAULIC CONTROL CIRCUIT FOR WORK MACHINE

BACKGROUND OF THE INVENTION

1. Field of Invention

The invention relates to a hydraulic control circuit for a work machine.

2. Description of Related Art

Work machines have a working portion that can be offset so as to swing laterally. In such work machines, there is a fear that a corresponding working portion may be brought into collision with the operator's cab when the working portion moves. In these cases, measures should be taken to avoid collision or contact between the working portion and the operator's cab.

Therefore, some work machines are provided with a position detecting means to detect the position of a working portion, and a control unit which is in charge of judging, on the basis of detection signals from the corresponding position detecting means, whether or not the working portion approaches the operator's cab beyond an appointed range, wherein if it is judged that the working portion approaches the operator's cab within the appointed range, a control command is issued from the control unit to a hydraulic circuit of a hydraulic actuator for the working portion, thereby stopping the movement of the working portion.

Such a work machine is shown in FIG. 8. However the electromagnetic proportional pressure reducing valves 57A and 57B, which operate based on commands from the control unit, are provided between a pilot type control valve 55, which controls feeding of pressurized oil to a hydraulic actuator 54 for a boom cylinder, and pilot valves 56A and 56B, which outputs pilot pressurized oil based on the operation of an operation lever. When the working portion is apart from the operator's cab, the electromagnetic proportional pressure reducing valves 57A and 57B are opened to allow pilot pressurized oil to be supplied to the control valve 55. However, when the working portion approaches the operator's cab, the electromagnetic proportional pressure reducing valves 57A and 57B are closed to shut off the pilot pressurized oil to the control valve 55, whereby the working portion is caused to stop. Thus, working efficiency is lowered when the working portion stops while the work machine operates.

Further, where work is carried out at places where underground electric wires exist or other underground obstacles reside, it is preferable to have a control means that prevents the working portion from being brought into contact with these obstacles. However, if such a control means is incorporated in a hydraulic control circuit of the working portion in addition to an interference prevention controlling means with respect to the abovementioned working portion and the operators cab, the circuit can be complex.

SUMMARY OF THE INVENTION

In various exemplary embodiments of a hydraulic control circuit for a work machine, the hydraulic control circuit includes a plurality of hydraulic actuators to actuate the working portion, and control valves that control feeding of pressurized oil to the respective hydraulic actuators, the hydraulic control circuit includes a valve driver to actuate the control valves on the basis of control commands from the control unit in the corresponding hydraulic control circuit, a control unit that determines whether or not the working portion has reached the predetermined interference prevention area and the limit position on the basis of input signals from a position detector which detects the position of the working portion, an interference prevention controller that, when it is judged by the corresponding determiner that the working portion has reached the interference prevention area, outputs control commands to the valve driver to stop the hydraulic actuators or to actuate the hydraulic actuators in a direction by which the working portion moves away from the work machine, and a position limitation controller that outputs control commands to stop the hydraulic actuators to the valve driver when it is judged by the determiner that the working portion has reached the limit position.

In another exemplary embodiment, the hydraulic control circuit for a work machines with a plurality of hydraulic actuators to actuate the working portion and control valves to control the feeding of pressurized oil to the respective hydraulic actuators, includes a valve driver to actuate the control valves on the basis of control commands from the control unit, and at the same time, the work machine is provided with, in the control unit, a determiner that determines whether or not the working portion has reached the predetermined interference prevention area with respect to the work machine body on the basis of input signals from the position detector to detect the position of the working portion, and an interference prevention controller that, when it is judged by the corresponding determiner that the working portion has reached the interference prevention area, outputs control commands to the valve driver to stop the hydraulic actuators or to actuate the hydraulic actuators in the direction by which the working portion moves away from the work machine wherein when the position limitation controller for outputting control commands to stop the corresponding hydraulic actuator in a case where the hydrauic actuators reach the limit position established separately from the abovementioned interference prevention area in the corresponding work machine, the determiner judges whether the hydraulic actuators reach the limit position, and a stop controlling command of the hydraulic actuators outputted from the position limitation controller is outputted to the valve driver which receives an output controlling command from the abovementioned interference prevention controller to stop the hydraulic actuators.

As such, the valve driving means may be constructed of a valve means which respectively carry out feeding and shut-off of pilot pressurized oil to the respective control valves on the basis of control commands from the control unit.

Also, in a work machine provided with hydraulic cylinders for booms which are swingable vertically and laterally with respect to the machine body as hydraulic cylinders, and hydraulic cylinders for sticks which actuates the sticks swingably connected to the tip end portion of the booms, such a work machine is provided with a interference prevention controller where the mechanism can continue a boom actuation while avoiding invasion by the working portion into the interference preventing area. The work machine can accomplish this by actuating the stick in a direction away from the interference prevention area when it is judged that at least while the boom is operating, the working portion has reached the interference preventing area, whereby it is possible to continue the operation while avoiding invasion by the working portion into the interference preventing area, and thus improve working efficiency.

BRIEF DESCRIPTION OF THE DRAWINGS

FIG. 4 is a table showing control commands of the interference prevention control;

DETAILED DESCRIPTION OF EXEMPLARY EMBODIMENTS

Figure 1:
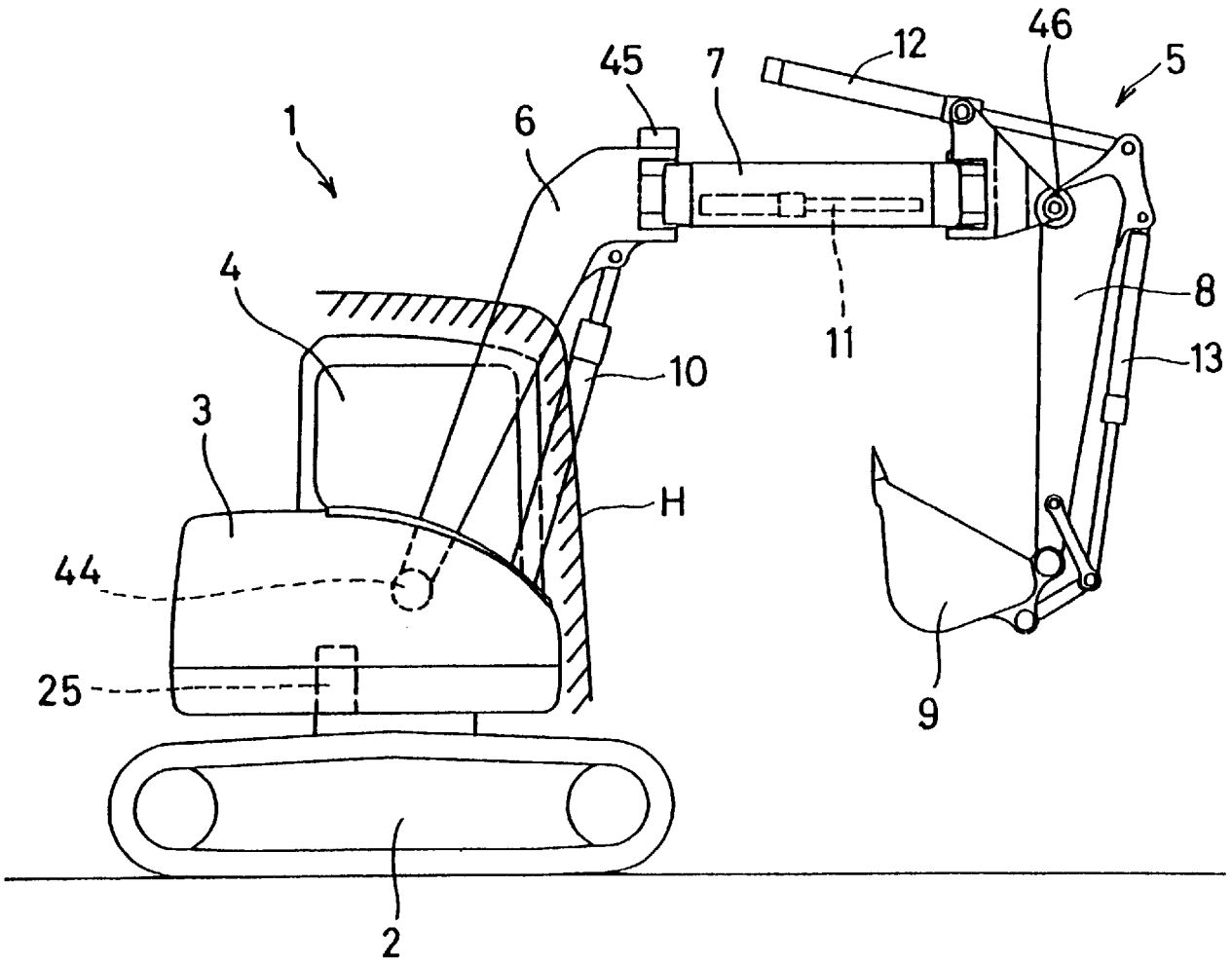
FIG. 1 is a side elevational view of a hydraulic shovel.

Next, a description is given of an exemplary embodiment of the invention with reference to the accompanying drawings. In FIG. 1, a hydraulic shovel 1 is composed of a crawler type lower structure 2, upper structure 3, cab 4, and working portion 5. The working portion 5 consists of a rear boom 6 whose base end portion is supported so as to be vertically swingable on the upper structure 3, a front boom 7 that is connected to the tip end portion of the rear boom 6 so as to be laterally swingable, a stick 8 that is connected to the tip end portion of the corresponding front boom 7 so as to be swingable laterally and back and forth, a bucket 9 that is connected to the tip end portion of the corresponding stick 8 so as to be swingable back and forth, a boom cylinder 10 that causes these members to swing, an offset cylinder 11, a stick cylinder 12, and a bucket cylinder 13. The basic construction thereof is similar to that of the prior art. In the embodiment, the cab 4 is installed at the right side portion of the upper structure 3.

In addition, the rear boom 6 is constructed so that it is caused to descend due to contraction of the boom cylinder 10 and is caused to ascend by expansion of the boom cylinder 10. Also, the front boom 7 is constructed so that it is caused to move in the left direction due to contraction of the offset cylinder 11, that is, move in a direction approaching the cab 4, and is caused to move in the right direction due to expansion of the offset cylinder 11. The stick 8 swings backward of the machine (stick-in) due to expansion of the stick cylinder 12 and swings frontward of the machine (stick-out) due to contraction of the stick cylinder 12.

Figure 2:
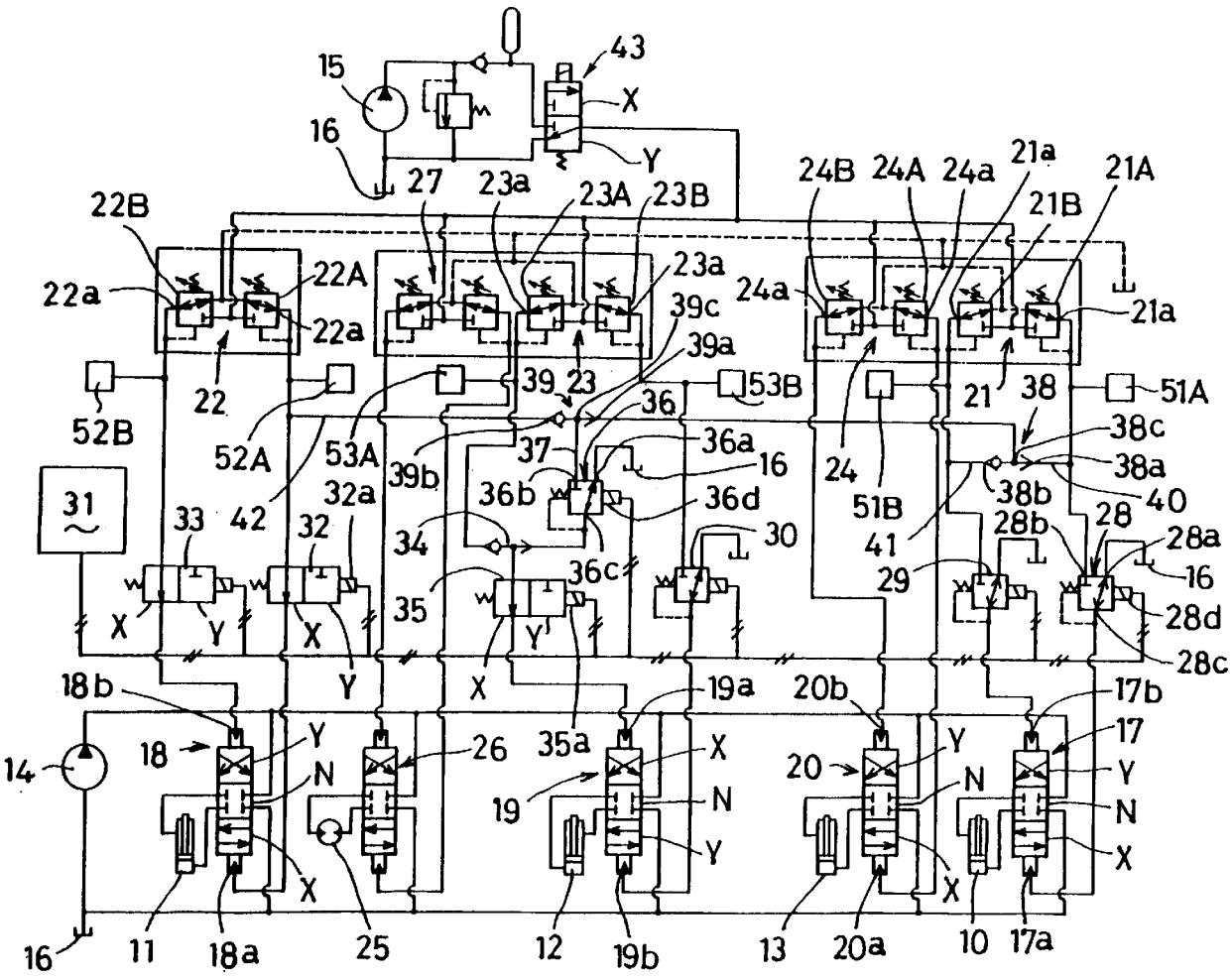
FIG. 2 is a hydraulic control circuit diagram of hydraulic actuators.

FIG. 2 shows a sketch of a hydraulic control circuit diagram of the respective cylinders 10 through 13. In the drawing, the numeral 14 indicates a main pump, 15 indicates a pilot pump, 16 indicates an oil tank, and 17 through 20 indicate control valves for boom, offset, stick and bucket, respectively. These respective control valves 17 through 20 are composed of pilot-operated type three-position selector valves, which are provided with contraction side pilot ports 17*a* through 20*a*, and expansion side pilot ports 17*b* through 20*b*.

The respective control valves 17 through 20 are positioned at the neutral position N, at which no pressurized oil is fed to the corresponding cylinders 10 through 13, in a state where no pilot pressurized oil is supplied to both pilot ports 17*a* through 20*a* and 17*b* through 20*b*. However, by pilot pressurized oil being fed to the contraction side pilot ports 17*a* through 20*a*, the control valves are changed to the contraction side position X at which pressurized oil is fed from the main pump 14 to the contraction side oil chamber of the cylinders 10 through 13, and by pilot pressurized oil being fed to the expansion side pilot ports 17*b* through 20*b*, the control valves are changed to the expansion side position Y at which pressurized oil is fed from the main pump 14 to the expansion side oil chamber of the cylinders 10 through 13.

Numerals 21 through 24 are pilot valves for boom, offset, stick and bucket, which feed pilot pressurized oil to the respective control valves 17 through 20 on the basis of operations by the corresponding operating tools. These respective pilot valves 21 through 24 are composed of the contraction side pilot valves 21A through 24A and expansion side pilot valves 21B through 24B.

The pilot valves 21 through 24 are constructed so that, by operating the corresponding operating tool to the contraction side or expansion side, pilot pressurized oil having a pressure corresponding to the degree of operation of the operating tools is outputted from output ports 21*a* through 24*a* of the pilot valves 21A through 24A or 21B through 24B at the corresponding operation side.

In FIG. 2, the numerals 25, 26 and 27, respectively, indicate a swing motor, a swing control valve, and a swing pilot valve to swing the upper structure 3.

Respective electromagnetic proportional pressure reducing valves 28, 29 and 30 at the contraction side of the boom, expansion side of the boom, and expansion side of the stick are, respectively, provided at a boom contraction side pilot oil line which connects the boom contraction side pilot valve 21A and the boom control valve contraction side pilot port 17*a* together, at the boom expansion side pilot oil line which connects the boom expansion side pilot valve 21B and the boom control valve expansion side pilot port 17*b* together, and at the stick expansion side pilot oil line which connects the stick expansion side pilot valve 23B and the stick control valve expansion side pilot port 19*b* together.

Since the electromagnetic proportional pressure reducing valves 28, 29 and 30 are similar to each other, a description is given, using the boom contraction side electromagnetic proportional pressure reducing valve 28 as an example. The valve 28 includes three ports 28*a*, 28*b*, 28*c* and solenoid 28*d*, wherein the first port 28*a* is connected to an oil tank 16, the second port 28*b* is connected to the output port 21*a* of the boom contraction side pilot valve 21A, and the third port 28*c* is connected to the contraction side pilot port 17*a* of the boom control valve 17.

The electromagnetic proportional pressure reducing valve 28 opens a valve channel by which the first port 28*a* communicates with the third port 28*c* in a state where the solenoid 28*d* is not excited, and closes the second port 28*b*, whereby oil in the contraction side pilot port 17*a* is discharged into the oil tank 16. However, if the solenoid 28*d* is excited on the basis of a control command from a control unit 31 described later, an output valve channel, by which the second port 28*b* is caused to communicate with the third port 28*c*, is opened. Therefore, since the corresponding output valve channel is opened, pilot pressurized oil from the boom contraction side pilot valve output port 21*a* is outputted to the boom control valve contraction side pilot port 17*a*, wherein the corresponding output pressure is increased or decreased in response to a control command outputted from the control unit 31 to an excitation circuit of the solenoid 28*d*.

Respective electromagnetic selector valves 32 and 33 at the offset contraction side and at the offset expansion side are provided in the respective pilot oil lines of the offset contraction side pilot oil line, which connects the offset contraction side pilot valve 22A and offset control valve contraction side pilot port 18*a* together, and offset expansion side pilot oil line, which connects the offset expansion side pilot valve 22B and the offset control valve expansion side pilot port 18*b* together.

Since these electromagnetic selector valves 32 and 33 are similar to each other, a description is given, using the offset contraction side electromagnetic selector valve 32 as an example. This selector valve 32 is a two-position selector valve equipped with a solenoid 32*a*. In a state where the solenoid 32*a* is not excited, the selector valve is positioned at the feed position X where pilot pressurized oil outputted from the offset contraction side pilot valve 22A is fed to the offset control valve contraction side pilot port 18*a*. However, since the solenoid 32*a* is excited on the basis of a control command from the control unit 31, the selector valve 32 is changed to the interruption position Y at which feeding of pilot pressurized oil from the pilot valve 22A to the pilot port 18*a* is interrupted.

On the other hand, the first shuttle valve 34 and a stick contraction side electromagnetic selector valve 35 are provided in the stick contraction side pilot oil line which connects the stick contraction side pilot valve 23A and the stick control valve contraction side pilot port 19*a* together.

The pilot pressurized oil outputted from an electromagnetic proportional pressure reducing valve for avoidance, which is described later, and the pilot pressurized oil outputted from the stick contraction side pilot valve 23A are inputted into the first shuttle valve 34, wherein the high pressure side of the inputted pilot pressurized oil is selected and is outputted to the stick contraction side electromagnetic selector valve 35.

The stick contraction side electromagnetic selector valve 35 has a structure similar to that of the abovementioned electromagnetic selector valve 32 or 33. In a state where the solenoid 35a is not excited, the selector valve 35 is positioned at the feed position X at which pilot pressurized oil outputted from the first shuttle valve 34 is fed to the stick control valve contraction side pilot port 19*a*. However, as the solenoid 35*a* is excited on the basis of a control command from the control unit 31, the selector valve 35 is changed to the interruption position Y at which feeding of the pilot pressurized oil from the first shuttle valve 34 to the pilot port 19*a* is interrupted.

Further, the structure of the electromagnetic proportional pressure reducing valve 36 for avoidance is similar to that of the electromagnetic proportional pressure reducing valve 28, 29 or 30 described above, wherein the first port 36*a* thereof is connected to the oil tank 16, the second port 36*b* thereof is connected to a pilot oil line 37 described later, and the third port 36*c* thereof is connected to the first shuttle valve 34.

When the solenoid 36*d* becomes excited by an operation command from the control unit 31, the electromagnetic proportional pressure reducing valve 36 opens an output valve channel by which the second port 36*b* is caused to communicate with the third port 36*c*, and outputs pressurized oil of the pilot oil line 37 for avoidance to the first shuttle valve 34, wherein the corresponding output pressure may be increased or decreased in response to a control command from the control unit 31.

Herein, the pilot oil line 37 for avoidance is constructed so that pilot pressurized oil outputted from the respective pilot valves 21A and 21B at the boom contraction and expansion sides and the offset contraction side pilot valve 22A is fed to the pilot oil line 37 for avoidance via the second and third shuttle valves 38 and 39.

That is, a boom contraction side pilot branching oil line 40 is branched from an intermediate part of an oil line which connects the boom contraction side pilot valve 21A and the boom contraction side electromagnetic proportional pressure reducing valve 28 together, and a boom expansion side pilot branching oil line 41 is branched from an intermediate part of an oil line which connects the boom expansion side pilot valve 21B and the boom expansion side electromagnetic proportional pressure reducing valve 29 together, and further an offset contraction side pilot branching oil line 42 is branched from an intermediate part of an oil line which connects the offset contraction side pilot valve 22A and the offset contraction side electromagnetic selector valve 32 together.

The boom contraction side and expansion side pilot branching oil lines 40 and 41 are, respectively, connected to the inlet side first and second ports 38*a* and 38*b* of the second shuttle 38. However, the outlet side port 38*c* of the corresponding second shuttle valve 38 is connected to the inlet side first port 39*a* of the third shuttle 39. Also, the offset contraction side pilot branching oil line 42 is connected to the inlet side second port 39*b* of the third shuttle valve 39, and further, the outlet side port 39*c* of the corresponding third shuttle valve 39 is connected to the pilot oil line 37 for avoidance. In a case where pilot pressurized oil is outputted from the boom contraction side or expansion side pilot valve 21A or 21B, the pilot pressurized oil is fed to the pilot oil line 37 for avoidance via the boom contraction side or expansion side pilot branching oil line 40 or 41, the second shuttle valve 38 and the third shuttle valve 39. In a case where pilot pressurized oil is outputted from the offset contraction side pilot valve 22A, the pilot pressurized oil is fed to the pilot oil line 37 for avoidance via the offset contraction side pilot branching oil line 42, and the third shuttle valve 39. In addition, in a case where pilot pressurized oil is outputted from both the boom contraction side or expansion side pilot valve 21A or 21B and the offset contraction side pilot valve 22A, the high pressure side pilot pressurized oil is fed to the pilot oil line 37 for avoidance.

The numeral 43 indicates a locking electromagnetic valve that is connected to the primary side (upstream side) of the pilot valves 21 through 24, and 27. The locking electromagnetic valve 43 is constructed so that it is changed to a non-locked position X where the pilot pressurized oil from the pilot pump 15 is outputted to the pilot valves 21 through 24 and 27, and a locked position, where no pilot pressurized oil is outputted.

Figure 3:
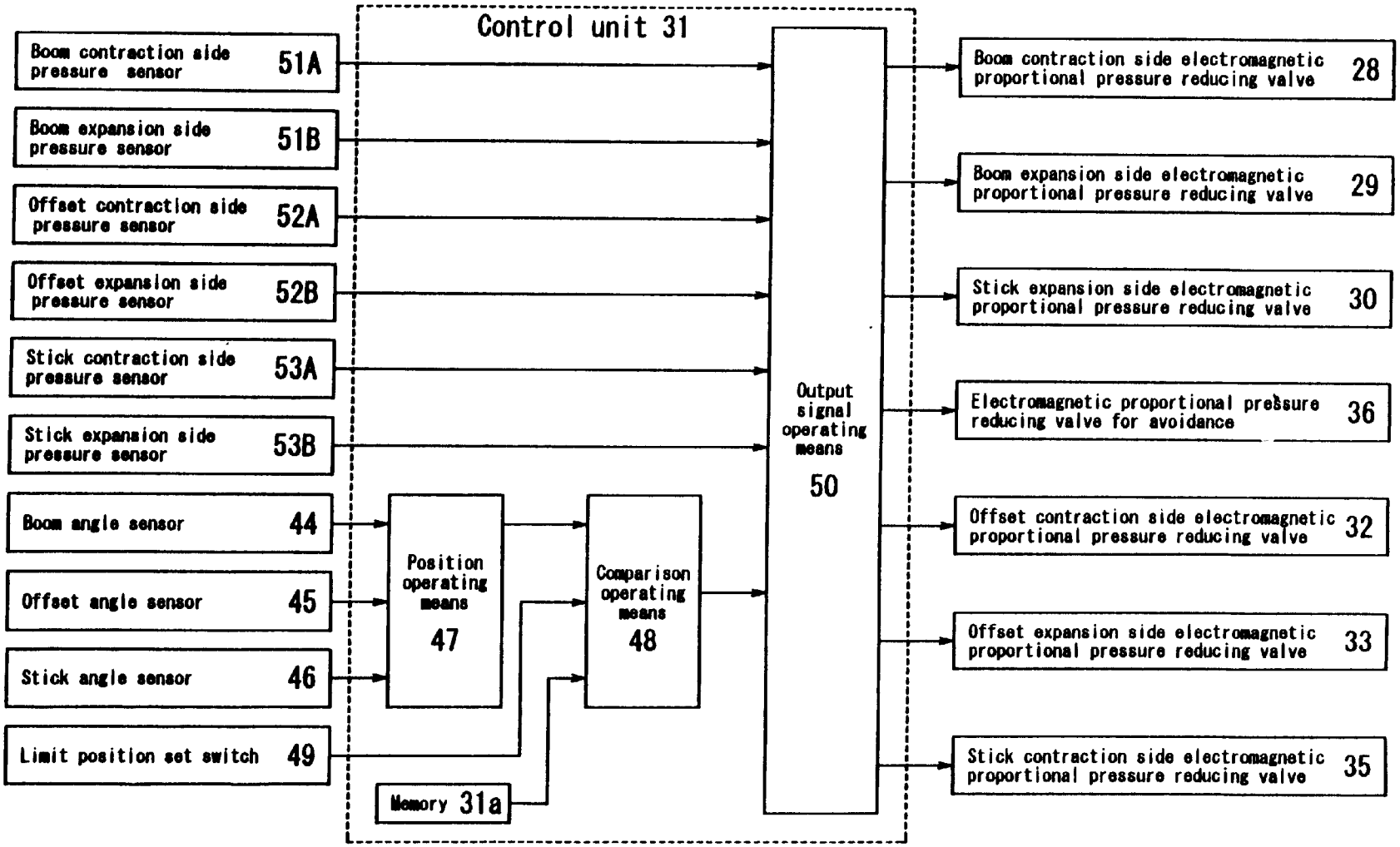
FIG. 3 is a block diagram showing a controlling procedure of interference prevention control.

As shown in FIG. 3, the control unit 31 inputs detection signals coming from a boom angle sensor 44 for detecting the relative angle with respect to the upper structure 3 of the rear boom 6, an offset angle sensor 45 for detecting the relative angle with respect to the rear boom 6 of the front boom 7, and a stick angle sensor 46 for detecting the relative angle with respect to the front boom 7 of the stick 8, and calculates the positions of the rear boom 6, front boom 7 and stick 8 by using a position operating means 47 on the basis of the corresponding detection signals. The control unit 31 then outputs the corresponding results calculation to a comparison operator 48.

Further, a limit position P established by the limit position set switch 49 is inputted in the comparison operator 48.

The interference prevention area H (for example, in a range within 300 mm from the cab 4), which is established on the assumption that the working portion 5 must not approach any closer to the cab 4, is stored in a memory 31*a* of the control unit 31.

The comparison operator 48 calculates the position of the working portion 5, which is calculated by the abovementioned position operator 47, with the interference prevention area H and limit position, and outputs the results of the calculation to the output signal operator 50. In this case, on the assumption that the bucket 9 closely approaches the interference prevention area H and limit position, the position of the working portion 5, interference prevention area H, and limit position are calculated for comparison with each other.

In addition, various signals are inputted into the abovementioned output signal operator 50. The signals are from a boom contraction side pressure sensor 51A for detecting the output of pilot pressurized oil from the boom contraction side pilot valve 21A, and boom expansion side, offset contraction side, offset expansion side, stick contraction side, and stick expansion side pressure sensors 51B, 52A, 52B, 53A and 53B for respectively detecting the output of pilot pressurized oil from each of the boom expansion side, offset contraction side, offset expansion side, stick contraction side, and stick expansion side pilot valves 21B, 22A, 22B, 23A and 23B.

And, the output signal operator 50 is constructed so that, on the basis of input signals from the comparison operator 48, and pressure sensors 51A, 51B, 52A, 52B, 53A and 53B, control commands are provided to solenoid excitation circuits of respective electromagnetic proportional pressure reducing valves 28, 29, 30, and 36 for the boom contraction side, boom expansion side, stick expansion side and avoidance, and of respective electromagnetic selector valves 32, 33, and 35 for offset contraction side, offset expansion side and stick contraction side.

Herein, the limit position may be optionally established or cancelled by an operator, using a limit position set switch 49, with respect to all or a part of the height, depth, reach, right offset and left offset positions. By setting the corresponding limit positions, the movable range of the working portion 5 can be limited.

Further, in the embodiment, in a bucket pilot oil line which feeds pilot pressurized oil from the bucket pilot valve 24 to the bucket control valve 20 and swing pilot oil line which feeds pilot pressurized oil from the swing pilot valve 27 to the swing control valve 26, neither electromagnetic proportional pressure reducing valve nor electromagnetic selector valve that operates by a control command from the control unit 31 is provided, wherein pilot pressurized oil outputted from the respective pilot valves 24 and 27 on the basis of operation of the operating tools is fed to the control valves 20 and 26 as it is. That is, the bucket 9 and swing operations are composed so that they are carried out, corresponding to operations of the operating tools at all times, regardless of interference prevention control and position limiting control made by the control unit 31, which are described later.

Next, a description is given of the interference prevention control and position limiting control made by the control unit 31. Where the abovementioned comparison operator 48 calculates that the working portion 5 is distant by a predetermined distance from the interference prevention area H and it does not reach the limit position, the output signal operating means 50 outputs normal control commands to the respective electromagnetic proportional pressure reducing valves 28, 29, 30 and 36 and respective electromagnetic selector valves 32, 33 and 35.

That is, with respect to the respective electromagnetic proportional pressure reducing valves 28, 29, and 30 for boom contraction side, boom expansion side, and stick expansion side, where the respective pressure sensors 51A, 51B and 53B for boom contraction side, boom expansion side and stick expansion side do not detect any output of pilot pressurized oil, the output valve line is closed, and on the basis that output of the pilot pressurized oil is detected, a control command is outputted so that the output valve line is fully opened. Also, with respect to the respective electromagnetic selector valves 32, 33, and 35 for offset contraction side, offset expansion side, and stick contraction side, a control command is outputted so that the respective selector valves are positioned at the feed positions X. Still further, with respect to the electromagnetic proportional pressure reducing valve 36 for avoidance, a control command is outputted so that the output valve line is closed.

Thereby, in a case where on the basis of the operation of the operating tools, pilot pressurized oil is outputted from the respective pilot valves 21A, 21 B, 23A, 23B, 22A, and 22B for boom contraction side, boom expansion side, stick contraction side, stick expansion side, offset contraction side and offset expansion side, the corresponding pilot pressurized oil is fed, as it is, to the respective control valves 17, 18 and 19 for the boom, offset and stick via the fully opened electromagnetic proportional pressure reducing valves 28, 29 and 30 and electromagnetic selector valves 32, 33 and 35 positioned at the feed position X.

Herein, although the first shuttle valve 34, which selects the higher pressure side of the pilot pressurized oil outputted from the stick contraction side pilot valve 23A and pilot pressurized oil outputted from the electromagnetic proportional pressure reducing valve 36 for avoidance, the electromagnetic proportional pressure reducing valve 36 for avoidance does not output pilot pressurized oil, as described above, because the output valve line is closed. The pilot pressurized oil outputted from the stick contraction side pilot valve 23A is selected and is fed to the control valve 19.

That is, in a case where the working portion 5 is distant by an appointed distance or more from the interference prevention area H and does not reach the limit position, the working portion 5 operates, corresponding to the operation of the operating tools.

Contrary to this, in a case where the comparison operator 48 has calculated that the working portion 5 has approached the interference prevention area H within a predetermined range, the output signal operator 50 outputs a control command for speed deceleration with respect to the respective electromagnetic proportional pressure reducing valves 28, 29 and 30 for boom contraction, boom expansion and stick expansion .

That is, in a case where output of the pilot pressurized oil from the respective pilot valves 21A, 21B and 23B for boom contraction, boom expansion, and stick expansion is detected with respect to the respective electromagnetic proportional pressure reducing valves 28, 29 and 30, a solenoid excitation command is outputted so that the output valve line is opened in a state where the degree of opening is adjusted. In this case, the degree of opening of the output valve lines of the respective electromagnetic proportional pressure reducing valves 28, 29 and 30 is adjusted so that the closer the working portion 5 approaches the interference prevention area H, the smaller the output pressure from the valves 28, 29 and 30 becomes.

Thereby, in a case where, on the basis of the operation of the operating tools, pilot pressurized oil is outputted from the respective pilot valves 21A, 21B and 23B for boom contraction side, boom expansion side, and stick expansion side, the corresponding pilot pressurized oil is fed to the control valves 17 and 19 in a state where the pressure thereof is reduced by the electromagnetic proportional pressure reducing valves 28, 29 and 30.

That is, in a case where the working portion 5 has approached the interference prevention area H within an appointed distance, respective operations such as the ascent and descent of the boom, and stick-in are carried out in a decelerated state.

Further, where the comparison operator 48 calculates that the working portion 5 has reached the outer boundary area of the interference prevention area H, the output signal operator 50 outputs control commands for preventing interference to the respective electromagnetic proportional pressure reducing valves 28, 29, 30 and 36 and respective electromagnetic selector valves 32, 33 and 35 on the basis of a control command table as illustrated in FIG. 4. However, in the exemplary embodiment, two areas, one of which is an interference prevention area of the front side portion (front part and right side area) of the cab and the other of which is an interference prevention area of the roof portion of the cab, are established as the interference prevention areas, wherein individual control is carried out with respect to the respective areas.

In FIG. 4, the relationship between the operating state of the operating tools and operation commands given to the working portion 5 are illustrated. Herein, the operating states of boom descent, boom ascent, stick-out, stick-in, left offset, and right offset are judged on the basis of the input of detection signals from the pressure sensors 51A, 51B, 53A, 53B, 52A, and 52B for boom contraction side, boom expansion side, stick contraction side, stick expansion side, offset contraction side, and offset expansion side.

On the other hand, as regards operation commands of boom descent, boom ascent, and stick-in, a control command is outputted to the electromagnetic proportional pressure reducing valves 28, 29 and 30 for boom contraction, boom expansion , and stick expansion so that the output valve line is opened. In this case, the operation commands of the boom descent, boom ascent, and stick-in are outputted only when the respective operations of the boom descent, boom ascent, and stick-in are carried out, wherein in the corresponding operations, pilot pressurized oil outputted from the pilot valves 21 A, 21 B and 23B is fed to each of the boom control valve 17 and stick control valve 19 via the output valve lines of the electromagnetic proportional pressure reducing valves 28, 29 and 30, whereby the respective operations such as boom descent, boom ascent and stick-in are carried out.

Also, as regards the operation commands of left offset and right offset, a control command is outputted so that the offset contraction and offset expansion side electromagnetic selector valves 32 and 33 are positioned at the feed position X. In this case, the left offset and right offset operation commands are outputted only where the left offset and right offset are operated. Based on the corresponding operations, the pilot pressurized oil outputted from the pilot valves 22A and 22B is fed to the offset control valve 18 via the electromagnetic selector valves 32 and 33 positioned at the feed position. Thereby, various operations such as the left offset and right offset are carried out.

Further, operation commands of the stick out are outputted in not only a case where the stick-out is operated, but also a case where the stick-out is not operated. And, with respect to the operation command of the stick-out in a state where the stick-out operation is carried out, a control command is outputted to the electromagnetic proportional pressure reducing valve 36 for avoidance so that the output valve line is closed, and at the same time, a control command is outputted to the contraction side electromagnetic selector valve 35 for stick so that the selector valve 35 is positioned at the feed position X, whereby based on the operation of the stick-out, the pilot pressurized oil outputted from the pilot valve 23A is fed to the stick control valve 19 via the first shuttle valve 34 and the electromagnetic selector valve 35 at the feed position X, and the stick-out operation is carried out.

Contrary to this, in a case where an operation command of the stick-out is outputted in a state where no stick-out operation is provided, the operations of boom descent, boom ascent and left offset are, individually or in combination, carried out as shown in the control command table of FIG. 4, and the pilot pressurized oil outputted from any one of the pilot valves 21A, 21B, and 22A for boom contraction side, boom expansion side, and offset contraction side is fed to the pilot oil line 37 for avoidance. And, in this case, as regards the stick-out operation command, a control command is provided to the electromagnetic proportional pressure reducing valve 36 for avoidance so that the output valve line is opened, and at the same time, a control command is provided to the stick contraction side electromagnetic selector valve 35 so that the valve 35 is positioned at the feed position X. Thereby, the pilot pressurized oil of the pilot oil line 37 for avoidance is fed to the stick control valve 19 via the electromagnetic proportional pressure reducing valve 36, the first shuttle valve 34 and the electromagnetic selector valve 35 at the feed position X, whereby the stick-out operation is carried out.

On the other hand, with regard to operation commands of boom descent stop, boom ascent stop, and stick-in stop, a control command is provided to the electromagnetic proportional pressure reducing valves 28, 29 and 30 for boom contraction side, boom expansion side, and stick expansion side so that the output valve line is closed, whereby feeding of the pilot pressurized oil to the boom and stick control valves 17 and 19 is interrupted.

Further, regarding operation commands of stick-out stop, left offset stop, and right offset stop, a control command is outputted to electromagnetic selector valves 35, 32, and 33 for stick contraction side, offset contraction side and offset expansion side so that the selector valves are positioned at their interruption positions Y. Therefore, feeding of pilot pressurized oil to the stick and offset control valves 19 and 18 is interrupted, and the stick-out, left offset and right offset operations stop.

A description is now given for when the working portion 5 reaches the outside boundary part of the interference prevention area H in the interference prevention area of the front side portion, with reference to FIG. 4. In a case where a boom descent operation is independently carried out, boom descent and stick-out operation commands are outputted, whereby it is possible to continue the operation of boom descent while swinging out the stick 8 and avoiding the invasion by the working portion 5 into the interference prevention area H. In this case, the working portion 5 descends along the outside boundary part of the interference prevention area H.

In a case where the stick-in operation is independently carried out, an operation command of the stick-in stop operation is outputted, and in a case where the left offset operation is independently carried out, an operation command of the left offset stop is outputted, whereby the working portion 5 automatically stops, and it is possible to avoid the invasion by the working portion 5 into the interference prevention area H.

In a case where the boom descent and stick-in operations are carried out in combination, the boom descent and stick-out operation commands are outputted, and in a case where the boom descent and left offset operations are carried out in combination, the boom descent, stick-out and left offset operation commands are outputted. Further, in a case where the stick-in and left offset operations are carried out in combination, the stick-out and left offset operation commands are outputted. Still further, in a case where the boom descent, stick-in and left offset operations are carried out in combination, the boom descent, stick-out and left offset operation commands are outputted. Therefore, it is possible to continue the boom descent and left offset operations while swinging out the stick 8 and avoiding the invasion by the working portion 5 into the interference prevention area. In this case, the working portion 5 moves along virtually the outside boundary part of the interference prevention area H.

In a case where the boom ascent operation is independently carried out, the boom ascent and stick-out operation commands are outputted, whereby it is possible to continue the boom ascent operation while swinging out the stick 8 and avoiding the invasion by the working portion 5 into the interference prevention area H. In this case, the working portion 5 moves along virtually the outside boundary part of the interference prevention area H.

In a case where the boom ascent and stick-in operations are carried out in combination, the boom ascent and stick-out operation command are outputted, and in a case where the boom ascent and left offset operations are carried out in combination, the boom ascent, stick-out and left offset operation commands are outputted. In addition, in a case where the boom ascent, stick-in and left offset operations are carried out in combination, the boom ascent, stick-out and left offset operation commands are outputted. Thereby, it is possible to continue the boom ascent and left offset operations while swinging out the stick 8 and avoiding the invasion by the working portion 5 into the interference prevention area H, and in case, the working portion 5 moves along virtually the outside boundary part of the interference prevention area H.

Also, although not illustrated in FIG. 4, in a case where the stick-out and right offset operation is carried out with respect to control of the front side part interference prevention area, the stick-out and right offset operation commands are outputted. However, if the stick-out and right offset operations are carried out in combination with the abovementioned respective operations (as a matter of course, there is no case where the stick-out and stick-in operations are simultaneously performed, and where the right offset and left offset operations are simultaneously carried out), the stick-out and right offset operation commands are outputted in combination with the respective operation commands.

Next, a description is given of control when, in the roof part interference prevention area, the working portion 5 reaches the outside boundary part of the interference prevention area H. That is, in a case where the boom descent operation is independently carried out, the boom descent stop operation command is outputted, and in a case where the stick-in operation is independently carried out, the stick-in stop operation command is outputted. Also, in a case where the stick-out operation is independently carried out, the stick-out stop operation command is outputted, whereby the working portion 5 automatically stops, and it is possible to avoid the working portion from entering the interference prevention area H.

Also, with respect to an operation command in a case where the boom descent operation is independently carried out, it may be set that boom descent and stick-out operation commands can be outputted when the angle of the stick 8 is an angle of elevation as in the case where a boom descent and stick-in operations described later are carried out in combination. In this case, it is possible to continue the boom descent operation while swinging out the stick 8 and avoiding invasion by the working portion 5 into the interference prevention area H.

Figure 5:
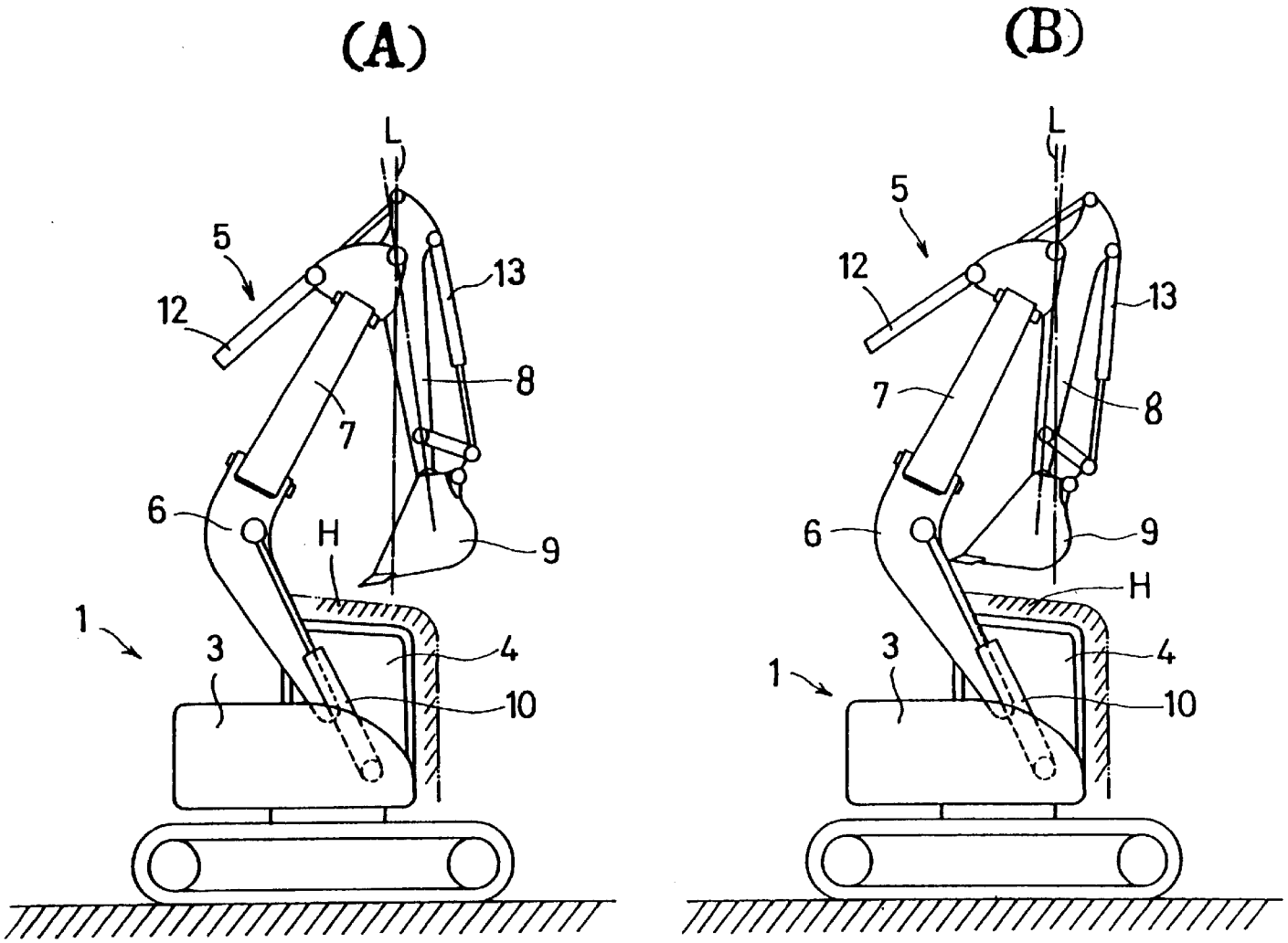
FIG. 5(A) shows a case where the angle of a stick is an angle of elevation.
FIG. 5(B) shows a case where the angle of the stick is an angle of declination.

In a case where the boom descent and stick-in operations are carried out in combination, the boom descent and stick-out operation commands or the boom descent stop and stick-in stop operation commands are outputted, depending on the posture of the stick 8. That is, as shown in FIG. 5(A), in a case where the angle of the stick 8 is an angle of elevation with respect to the vertical line L passing through the swing point of the stick 8, the boom descent and stick-out operation commands are outputted, whereby it is possible to continue the boom descent operation while swinging out the stick 8 and avoid the invasion by the working portion 5 into the interference prevention area H. In this case, the working portion 5 moves along the outside boundary part of the interference prevention area H. Also, as shown in FIG. 5(B), in a case where the angle of the stick 8 is an angle of declination with respect to the vertical line L passing through the swing point of the stick 8, the boom descent stop and stick-in stop operation commands are outputted, whereby the working portion 5 automatically stops, and the invasion thereof into the interference prevention area H can be avoided.

In a case where the boom descent and stick-out operations are carried out in combination, the boom descent stop and stick-out stop operation commands are outputted, whereby the working portion 5 automatically stops, and invasion thereof into the interference prevention area H can be avoided.

In addition, although not illustrated in FIG. 4, where boom ascent, left offset and right offset operations are performed in the control of the interference prevention area of the roof portion, the boom ascent, left offset and right offset operation commands are, respectively, outputted. However, in a case where the boom ascent, left offset and right offset operations are performed in combination with the respective operations described above (as a matter of course, there is no case where the boom ascent operation and boom descent operation are simultaneously carried out), the boom ascent, left offset and right offset operation commands are outputted in combination with the abovementioned respective operations.

Figure 6:
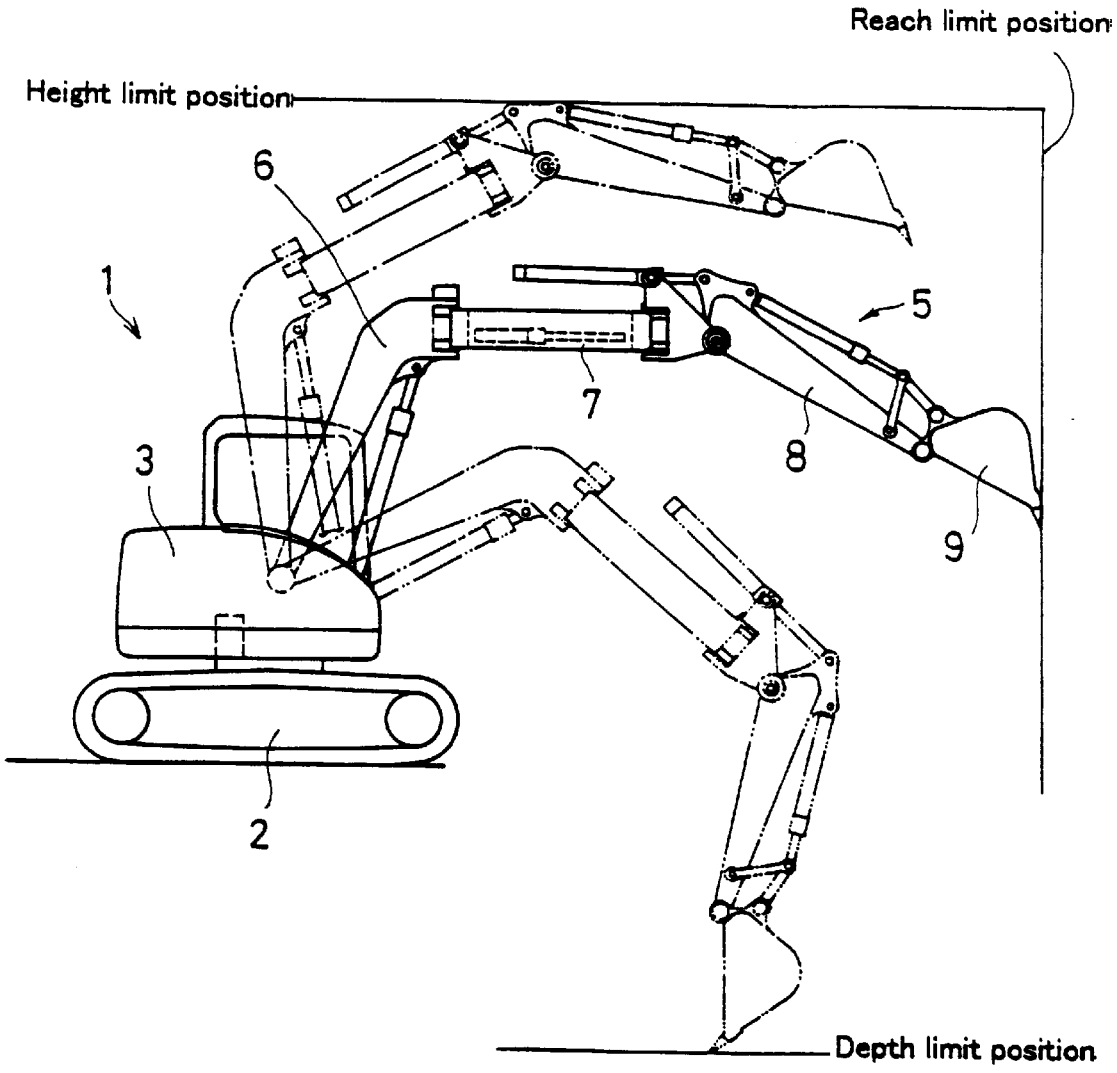
FIG. 6 is a view showing the limit position with respect to height, depth and reach.
Figure 7:
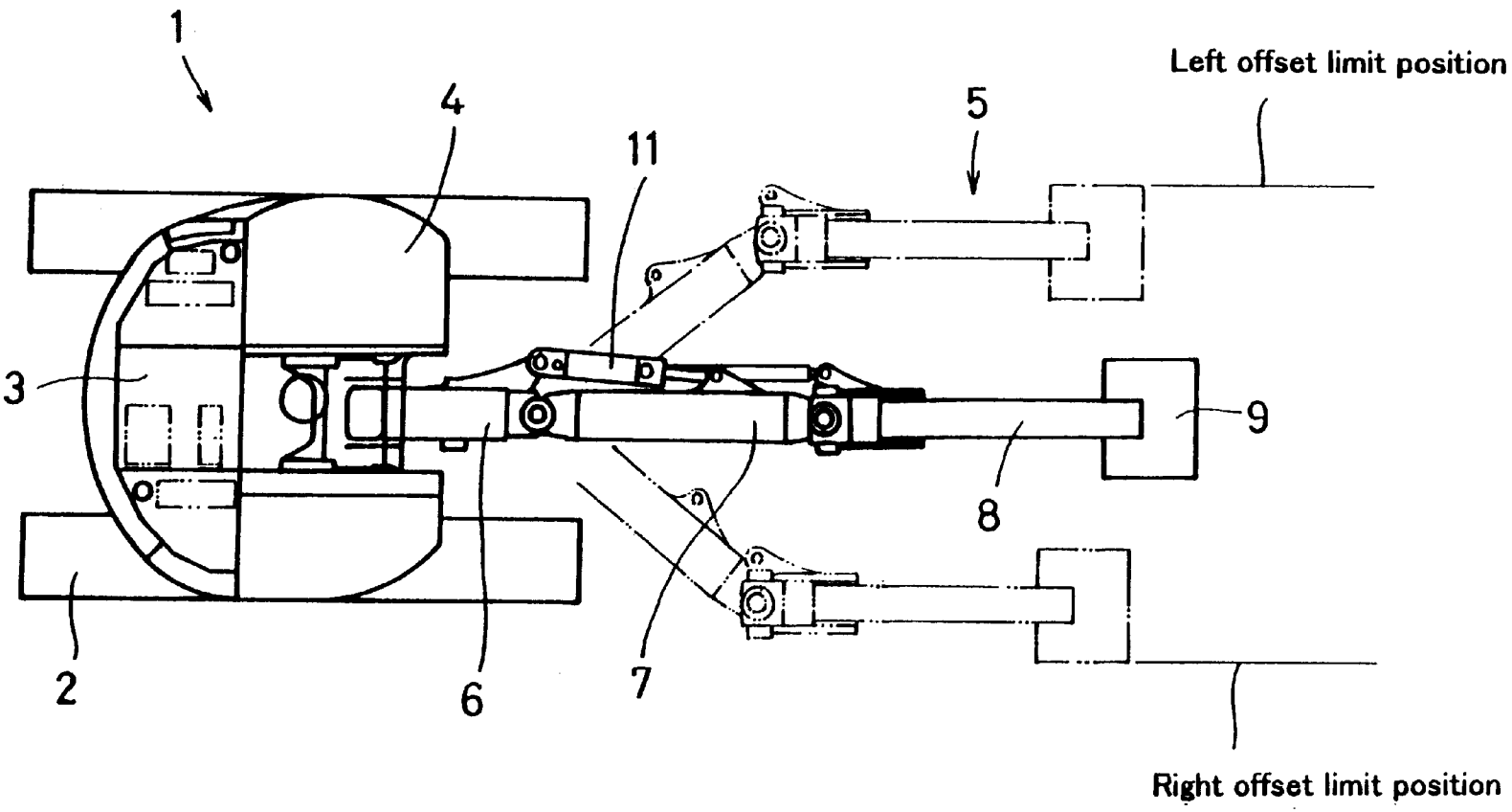
FIG. 7 is a view showing the limit position of left offset and right offset.
Figure 8:
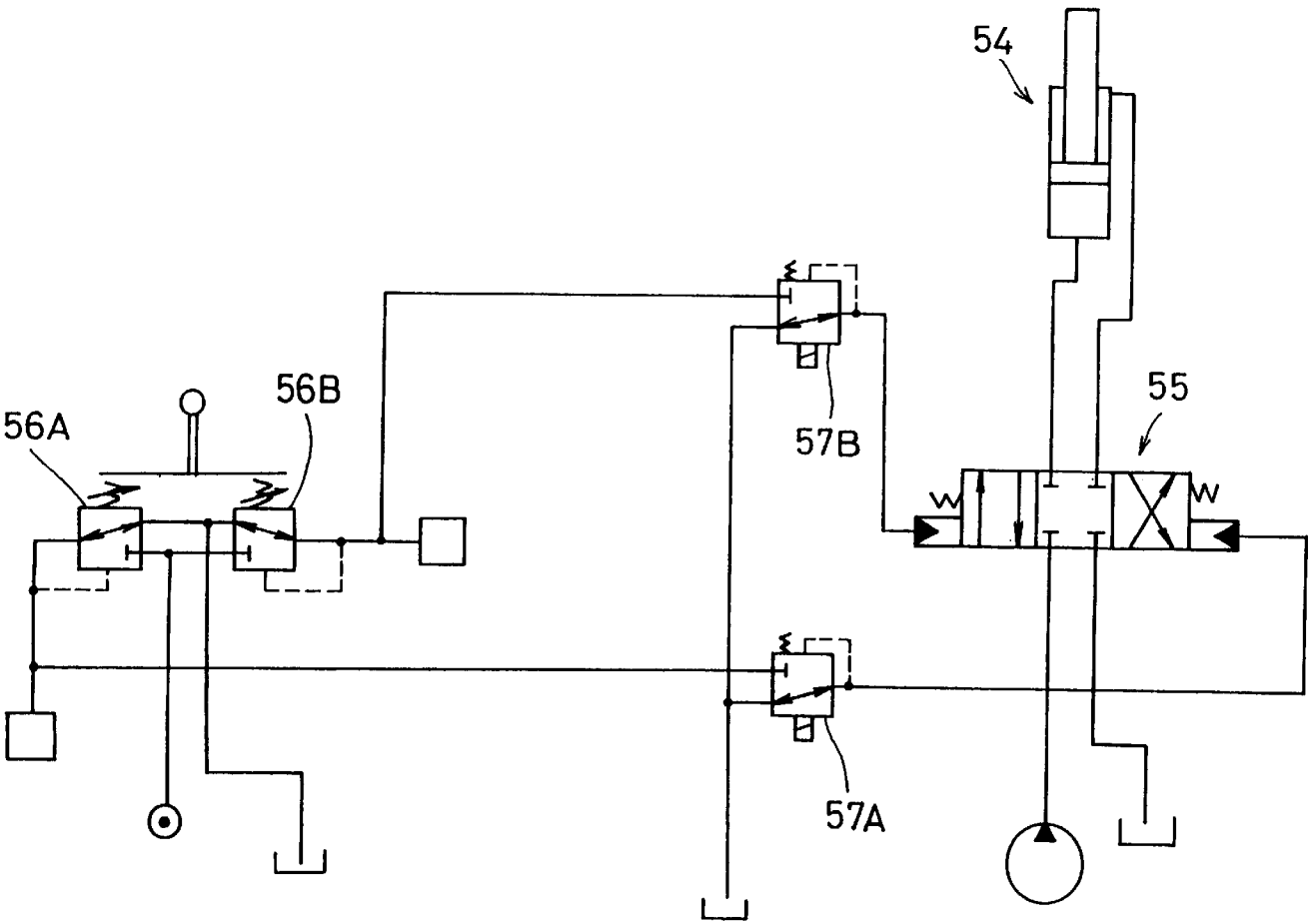
Fig. 8 RELATED ART
FIG. 8 is a hydraulic control circuit diagram of hydraulic actuators according to a prior art.

Further, where the comparison operator 48 calculates that the working portion 5 has reached the limit position, as shown in FIGS. 6 and 7, the output signal operator 50 outputs position-limiting control commands to the boom contraction side, boom expansion side, and stick elongation side electromagnetic proportional pressure reducing valves 28, 29 and 30 and offset contraction side, offset expansion side, and stick contraction side electromagnetic selector valves 32, 33 and 35. That is, where the working portion 5 reaches the limit position, in order to interrupt the feeding of pilot pressurized oil by which the working portion 5 is caused to move beyond the corresponding limit position, control commands are outputted to electromagnetic proportional pressure reducing valves 28, 29 and 30 of the corresponding pilot oil line, and electromagnetic selector valves 32, 33 and 35 thereof, so that the output valve lines are closed or so that the valves are position at the interruption positions Y.

Thereby, for example, where a height limit position is established by the limit position set switch 49, as the height of the working portion 5 reaches the abovementioned limit position when elevating the rear boom 6, the output valve line of the boom expansion side electromagnetic proportional pressure reducing valve 29 is closed, whereby the pilot pressurized oil going into the boom control valve expansion side pilot port 17*b* is interrupted, the rear boom 6 automatically stops elevating. As in the above, with respect to the depth, reach, and offset positions, as the working portion 5 reaches the set limit positions, the feeding of the pilot pressurized oil in the direction that exceeds the limit position P is interrupted, and the movement of the working portion 5 in the corresponding direction is automatically stopped.

In the construction described above, the working portion 5 can operate in response to operations of the operating tools where the working portion 5 is distant by an appointed distance from the interference prevention area H and does not reach the limit positions as described above. However, the working portion 5 automatically decelerates its moving speed as it approaches the interference prevention area H within the appointed distance, and further, corresponding to the operating state of the operating tools and the positions of the working portion 5, as it reaches the interference prevention area H, the working portion 5 automatically stops or the stick 8 automatically swings out, whereby it is possible to continue operations such as the boom 6 descent and ascent, left offset, etc., while avoiding the invasion by the working portion 5 into the interference prevention area H. On the other hand, when the working portion 5 reaches the limit positions, the working portion 5 automatically stops its movement.

As a result, in a case where the working portion 5 reaches the interference prevention area H, for example, while carrying out a boom descent operation, the stick 8 will automatically swing out and a descent operation of the boom 6 will continue while avoiding the interference prevention area H. Therefore, there will be no case where the operation completely stops as in the prior arts, whereby the operating efficiency thereof will be further improved. In addition, if limit positions to prevent the working portion 5 from being brought into contact with obstacles are set in advance by the limit position set switch 9 in a case where operations are carried out in places where obstacles such as electric wires or buried substances, etc., exist, the working portion 5 will automatically stop as it reaches the limit positions, whereby the operations can be efficiently performed without paying attention to contact with such obstacles.

Furthermore, in respective pilot oil lines for boom contraction side, boom expansion side, stick expansion side, and offset contraction side, which are provided with electromagnetic proportional pressure reducing valves 28, 29, 30 and electromagnetic selector valve 32 to carry out interference prevention control, these electromagnetic proportional pressure reducing valves 28, 29 and 30 and electromagnetic selector valve 32 may be used, as they are, for position limiting control, and in only pilot oil lines for stick contraction side and offset expansion side, which are not provided with any interference prevention controlling valve, electromagnetic selector valves 33 and 35 for position limiting control are incorporated therein. Therefore, those components may be commonly used, wherein the hydraulic circuits may be simplified.

Still further, both the interference prevention control and position limiting control are composed so as to be. performed by the same control procedures in which the position operator 47 calculates the position of the working portion 5 on the basis of detection signals from the boom angle sensor 44, offset angle sensor 45, and stick angle sensor 46, the comparison operator 48 compares the corresponding results of the calculation with the interference prevention area H and the limit positions, the output signal operator 50 outputs, on the results thereof, control commands to the respective electromagnetic proportional pressure reducing valves 28, 29, 30 and 36 and electromagnetic selector valves 32, 33, and 35. Therefore, the control can be simplified.

Also, since such a construction is composed so that operations can be continued while avoiding the interference prevention area H by only causing the stick 8 to automatically swing out, it is enough that a circuit which causes a cylinder to automatically contract (collapse) is incorporated in only the circuit of the stick cylinder 12 among hydraulic actuators secured in the working portion 5, whereby the circuits thereof can be simplified, and thus reduce production costs. Also, only the stick 8 automatically swings out, whereby the interference avoiding operation is simplified, and an operator can easily recognizes the situation.

Also, it is needless to say that the invention is not limited to only the embodiment. When feeding pilot pressurized oil to cause the stick 8 to automatically swing out, pilot pressurized oil outputted from the pilot pressurized oil source may be used as it is. However, the embodiment is constructed so that pilot pressurized oil outputted in line with boom descent, boom ascent and left offset operations is used. Therefore, should trouble occur such as the stick 8 swinging out beyond control because the stick contraction side electromagnetic proportional pressure reducing valve 34 fails and operates by mistake, an advantage can be enjoyed, by which uncontrolled swing-out of the stick 8 can be stopped by stopping boom descent, boom ascent and left offset operations.

What is claimed is:

1. A hydraulic control circuit for a work machine with a plurality of hydraulic actuators for actuating a working portion, control valves that control the feeding of pressurized oil to the respective hydraulic actuators, a control unit, and a valve drive means to actuate the control valves on the basis of control commands from the control unit, the control circuit comprising:

a means for judging whether the working portion has reached an interference preventing area predetermined with respect to an operator's cab and a limit position set so as to prevent the working portion from being brought into contact with obstacles other than the operator's cab, on the basis of input signals from a position detecting means to detect the position of the working portion;

an interference prevention controlling means that, when it is judged by the judging means that the working portion has reached the interference preventing area, outputs to a valve driving means control commands to one of stop the hydraulic actuators and to actuate the hydraulic actuators in the direction by which the working portion moves away from the work machine based on the position of the working portion; and a position limitation controlling means that outputs control commands to stop the hydraulic actuators to the valve driving means when it is judged by the judging means that the working portion has reached the limit position, wherein the valve driving means comprises an interference prevention electromagnetic valve that is changed so as to feed pilot pressurized oil to actuate a first hydraulic actuator of the plurality of hydraulic actuators to a pilot oil line to actuate a second hydraulic actuator in a direction away from the interference prevention area and a stop electromagnetic valve to stop the operations of said hydraulic actuators.

2. The hydraulic control circuit for a work machine as set forth in claim 1, wherein the valve driving means is a valve means that feeds and interrupts pilot pressurized oil to respective control valves on the basis of control commands from the control unit.

3. The hydraulic control circuit for a work machine as set forth in claim 2, wherein, the work machine is provided with hydraulic cylinders for booms, which actuate the booms which are swingable vertically and laterally with respect to the machine body, and hydraulic cylinders for a stick, which actuate the stick swingably connected to the tip end portion of said booms, the hydraulic control circuit provided with a mechanism in the interference prevention controlling means, wherein the mechanism continues a boom actuation while avoiding the invasion of the working portion into the interference prevention area by actuating said stick in a direction away from said interference prevention area when it is judged that at least while the boom is operating, the working portion has reached the interference preventing area.

4. The hydraulic control circuit for a work machine as set forth in claim 1, wherein, the work machine is provided with hydraulic cylinders for booms, which actuate the booms which are swingable vertically and laterally with respect to the machine body, and hydraulic cylinders for a stick, which actuate the stick swingably connected to the tip end portion of said booms, the hydraulic control circuit provided with a mechanism in the interference prevention controlling means, wherein the mechanism continues a boom actuation while avoiding the invasion of the working portion into the interference prevention area by actuating said stick in a direction away from said interference prevention area when it is judged that at least while the boom is operating, the working portion has reached the interference preventing area.

5. A method of operating a working portion, the method comprising the steps of:

determining a location of the working portion relative to an interference prevention area predetermined with respect to an operator's cab and a limit position set so as to prevent the working portion from being brought into contact with obstacles other than the operator's cab;

controlling the working portion when it has been determined that the working portion has reached the interference prevention area so as to move the working portion away from the interference prevention area; and controlling the working portion when it has been determined that the working portion has reached the limit position so as to move the working portion away from the interference prevention area with an interference prevention valve and to stop an operation of the working portion with a stop valve.

6. The method of operating of claim 5, wherein the working portion is controlled by a valve driving means that feeds and interrupts pressurized oil to respective control valves.

7. A hydraulic control circuit for a work machine, comprising:

a plurality of hydraulic actuators;

control valves for feeding pressurized oil to the respective hydraulic actuators;

valve drive means to actuate the control valves;

means for determining the location of a working portion relative to the work machine;

an interference prevention controlling means that outputs to the valve driving means control commands to one of stop the hydraulic actuators and to actuate the hydraulic actuators in the direction by which the working portion moves away from the work machine based on the location of the working portion when the working portion moves within an interference prevention area predetermined with respect to an operator's cab; and a position limitation controlling means that outputs control commands to an interference prevention electromagnetic valve so as to feed pilot pressurized oil to actuate a first hydraulic actuator of the plurality of hydraulic actuators to a pilot oil line to actuate a second hydraulic actuator in a direction away from the interference prevention area and a stop electromagnetic valve to stop the operations of the hydraulic actuators when the working portion moves to a limit position set so as to prevent the working portion from being brought into contact with obstacles other than the operator's cab.

8. The hydraulic control circuit for a work machine as set forth in claim 7, wherein the valve driving means is a valve means that feeds and interrupts pilot pressurized oil to respective control valves on the basis of control commands.

9. The hydraulic control circuit for a work machine as set forth in claim 8, wherein the work machine is provided with hydraulic cylinders for booms, which actuate the booms which are swingable vertically and laterally with respect to the machine body, and hydraulic cylinders for a stick, which actuate the stick swingably connected to the tip end portion of the booms, the hydraulic control circuit provided with a mechanism in the interference prevention controlling means, wherein the mechanism continues a boom actuation while avoiding the invasion of the working portion in the interference prevention area by actuating the stick in a direction away from the interference prevention area when it is judged that at least while the boom is operating, the working portion has reached the interference preventing area.

10. The hydraulic control circuit for a work machine as set forth in claim 7, wherein the work machine is provided with hydraulic cylinders for booms, which actuate the booms which are swingable vertically and laterally with respect to the machine body, and hydraulic cylinders for a stick, which actuate the stick swingably connected to the tip end portion of the booms, the hydraulic control circuit provided with a mechanism in the interference prevention controlling means, wherein the mechanism continues a boom actuation while avoiding the invasion of the working portion in the interference prevention area by actuating the stick in a direction away from the interference prevention area when it is judged that at least while the boom is operating, the working portion has reached the interference preventing area.

* * * * *